US009986881B2

(12) United States Patent
VanTongeren

(10) Patent No.: US 9,986,881 B2
(45) Date of Patent: Jun. 5, 2018

(54) VACUUM CLEANER

(71) Applicant: BISSELL Homecare, Inc.

(72) Inventor: Todd Richard VanTongeren, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days. days.

(21) Appl. No.: 15/182,961

(22) Filed: Jun. 15, 2016

(65) Prior Publication Data

US 2016/0367093 A1 Dec. 22, 2016

Related U.S. Application Data

(60) Provisional application No. 62/180,908, filed on Jun. 17, 2015.

(51) Int. Cl.

| | |
|---|---|
| ***A47L 9/22*** | (2006.01) |
| ***A47L 9/04*** | (2006.01) |
| ***A47L 9/16*** | (2006.01) |
| ***A47L 9/24*** | (2006.01) |
| ***A47L 9/32*** | (2006.01) |
| ***A47L 5/30*** | (2006.01) |
| ***A47L 9/02*** | (2006.01) |

(52) U.S. Cl.

CPC ..... *A47L 9/22* (2013.01); *A47L 5/30* (2013.01); *A47L 9/02* (2013.01); *A47L 9/0411* (2013.01); *A47L 9/0477* (2013.01); *A47L 9/242* (2013.01)

(58) Field of Classification Search

CPC ..... A47L 9/22; A47L 5/30; A47L 9/02; A47L 9/0411; A47L 9/0477; A47L 9/242; A47L 5/365; A47L 7/028; A47L 7/0042; A47L 9/2842; A47L 5/24

See application file for complete search history.

(56) References Cited

U.S. PATENT DOCUMENTS

| | | | | |
|---|---|---|---|---|
| 1,209,720 | A | 12/1916 | Kirby | |
| 1,209,721 | A | 12/1916 | Kirby | |
| 1,257,288 | A | 2/1918 | Kirby | |
| 2,058,371 | A | 10/1936 | Van Roosen | |
| 2,134,396 | A | 10/1938 | Campbell | |
| 2,504,846 | A | 4/1950 | Kirby | |
| 2,708,766 | A | 5/1955 | Thornwald | |
| 3,188,681 | A | 6/1965 | Jepson et al. | |
| 6,311,366 | B1 * | 11/2001 | Sepke | A47L 5/22 15/329 |
| 7,481,630 | B2 | 1/2009 | Liffers et al. | |
| 7,610,653 | B2 | 11/2009 | Courtney | |
| 9,427,122 | B2 * | 8/2016 | Conrad | A47L 5/225 |
| 2007/0022562 | A1 * | 2/2007 | Hampton | A47L 9/325 15/327.2 |
| 2009/0165242 | A1 * | 7/2009 | Lee | A47L 5/28 15/411 |

(Continued)

*Primary Examiner* — Dung Van Nguyen

(74) *Attorney, Agent, or Firm* — McGarry Bair PC

(57) ABSTRACT

A vacuum cleaner includes an upright body and a base carrying a suction nozzle that is pivotally coupled with the upright body for movement between at least a storage position and a reclined use position. A motor is in fluid communication with the suction nozzle and is mounted in the upright body in a configuration that partially offsets the weight-in-hand of the upright assembly as perceived by a user of the vacuum cleaner.

18 Claims, 7 Drawing Sheets

(56) References Cited

U.S. PATENT DOCUMENTS

| | | | | |
|---|---|---|---|---|
| 2012/0233806 | A1* | 9/2012 | Streciwilk | A47L 5/28 15/347 |
| 2014/0013537 | A1 | 1/2014 | Kasper | |
| 2015/0040340 | A1* | 2/2015 | Bilger | A47L 5/225 15/329 |

* cited by examiner

VACUUM CLEANER

CROSS-REFERENCE TO RELATED APPLICATION(S)

This application claims the benefit of U.S. Provisional Patent Application No. 62/180,908, filed Jun. 17, 2015, which is incorporated herein by reference in its entirety.

BACKGROUND OF THE INVENTION

Vacuum cleaners are provided with a vacuum collection system for creating a partial vacuum to suck up debris (which may include dirt, dust, soil, hair, and other debris) from a surface to be cleaned and for collecting the removed debris in a space provided on the vacuum cleaner for later disposal. Vacuum cleaners for household use can be configured as an upright unit having a base for movement across a surface to be cleaned and an upright body pivotally mounted to a rearward portion of the base for directing the base across the surface to be cleaned. The upright body is typically stored in an upright position relative to the base, and reclined relative to the base for operation. Using a handle on the upright body, the user moves the vacuum cleaner over a surface to be cleaned during operation. A portion of weight of the vacuum cleaner, particularly the base, is supported by the floor over which the vacuum cleaner is moved, and the remaining portion of the weight, particularly the upright body, must be supported by the user.

BRIEF DESCRIPTION OF THE INVENTION

According to one embodiment of the invention, a vacuum cleaner includes a base adapted to be moved along a surface to be cleaned and having a suction nozzle positioned at a forward end of the body, an upright body pivotally mounted to the base by a pivot connection for movement about a pivot axis between at least a storage position and a reclined use position, and a vacuum collection system having a motor/fan assembly provided in the upright body in fluid communication with the suction nozzle, a collection assembly for separating and collecting debris from the working airstream for later disposal, and a working air path through the base and upright body, the working air path extending from the suction nozzle and through at least the motor/fan assembly and the collection assembly. The motor/fan assembly has a center of gravity that is located forwardly of the pivot axis in both the storage position and the reclined use position.

According to another embodiment of the invention, a vacuum cleaner includes a base adapted to be moved along a surface to be cleaned and having a suction nozzle, an upright body pivotally mounted to the base by a pivot connection for movement about a pivot axis between at least a storage position and a reclined use position, and a vacuum collection system having a motor/fan assembly provided in the upright body above the pivot axis and in fluid communication with the suction nozzle, a collection assembly for separating and collecting debris from the working airstream for later disposal, and a working air path through the base and upright body, the working air path extending from the suction nozzle and through at least the motor/fan assembly and the collection assembly. The motor/fan assembly has a motor axis that forms an obtuse angle with a longitudinal axis of the upright body in both the storage position and the reclined use position.

According to yet another embodiment of the invention, a vacuum cleaner includes a base adapted to be moved along a surface to be cleaned and having a suction nozzle positioned at a forward end of the body, an upright body pivotally mounted to the base by a pivot connection for movement about a pivot axis between at least a storage position and a reclined use position, and having a supporting mount at a lower end thereof, a vacuum collection system having a motor/fan assembly in fluid communication with the suction nozzle, a collection assembly for separating and collecting debris from the working airstream for later disposal, and a working air path through the base and upright body, the working air path extending from the suction nozzle and through at least the motor/fan assembly and the collection assembly, and a motor housing containing the motor/fan assembly, wherein the motor housing is cantilevered to the upright body and projects forwardly from the supporting mount, and wherein at least a portion of the motor/fan assembly is positioned forward of the pivot axis in the reclined use position.

DESCRIPTION OF EMBODIMENTS OF THE INVENTION

The invention relates to vacuum cleaners and in particular to upright vacuum cleaners having an upright body pivotally mounted to a base that moves over a surface to be cleaned. In one of its aspects, the invention relates to an upright vacuum cleaner with an improved weight-in-hand. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
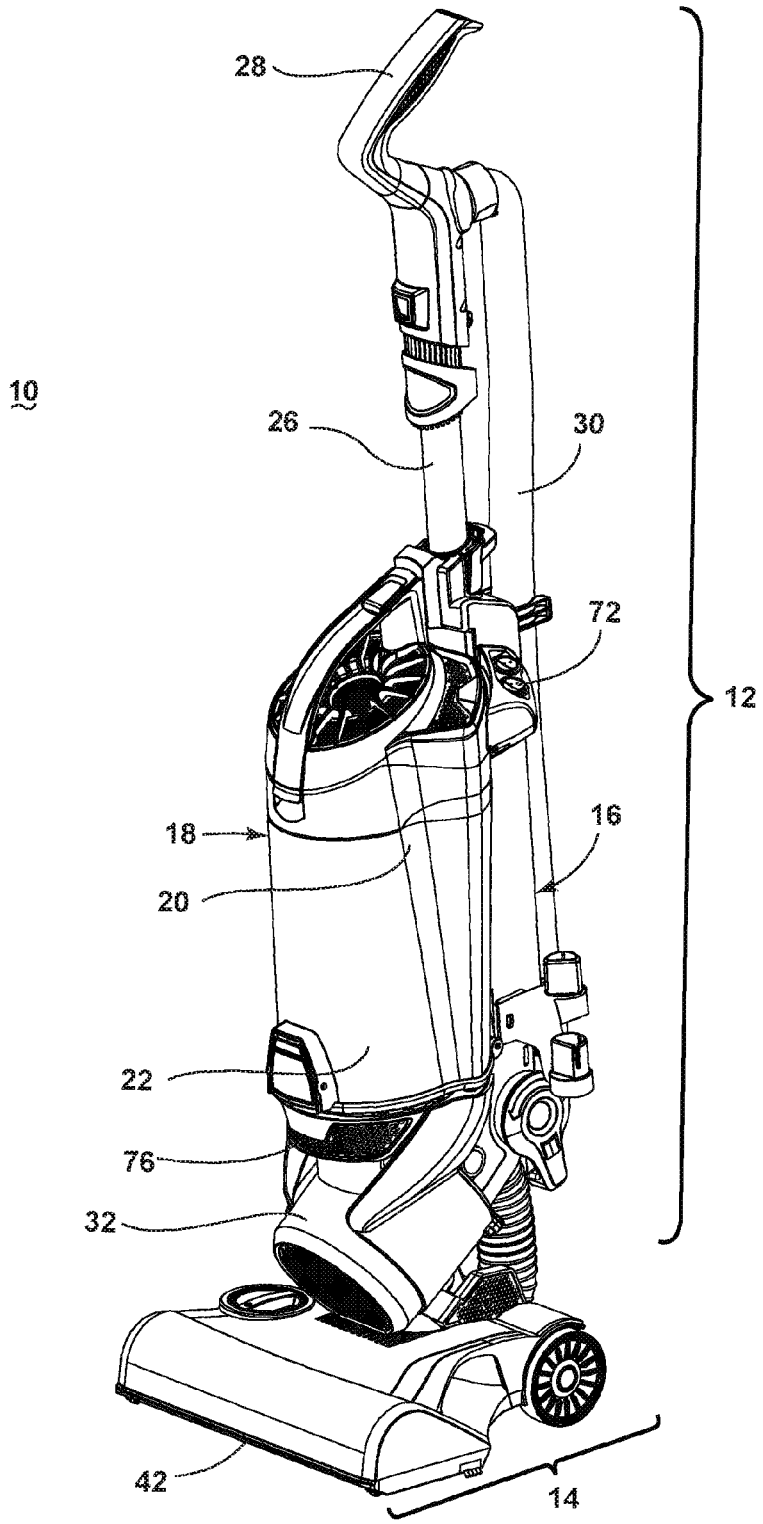
FIG. 1 is a front perspective view of a vacuum cleaner according to a first embodiment of the invention, with the vacuum cleaner shown in an upright storage position.

FIG. 1 is a front perspective view of a vacuum cleaner 10 according to a first embodiment of the invention. The vacuum cleaner 10 may be substantially similar to a conventional vacuum cleaner in that it includes a vacuum collection system for creating a partial vacuum to suck up debris (which may include dirt, dust, soil, hair, and other debris) from a surface to be cleaned and collecting the removed debris in a space provided on the vacuum cleaner 10 for later disposal. In some embodiments of the invention, not illustrated herein, the vacuum cleaner 10 can additionally have fluid delivery capability, including applying liquid or steam to the surface to be cleaned, and/or fluid extraction capability.

The vacuum cleaner 10 can be provided in the form of an upright vacuum cleaner having an upright body 12 pivotally mounted to a lower base 14. The upright body 12 generally comprises a main support section or spine 16 supporting a collection assembly 18 for separating and collecting contaminants from a working airstream for later disposal. In one conventional arrangement illustrated herein, the collection assembly 18 can include a cyclone separator 20 for separating contaminants from a working airstream and an integral dirt collector 22 for receiving and collecting the separated contaminants from the cyclone separator 20. The cyclone separator 20 can have a single cyclonic separation stage, or multiple stages. The dirt collector 22 can be provided with a bottom-opening dirt door for contaminant disposal. In another conventional arrangement, the collection assembly 18 can include a separate dirt cup. It is understood that other types of collection assembly 18 can be used, such as centrifugal separators or bulk separators. In yet another conventional arrangement, the collection assembly 18 can include a filter bag. The vacuum cleaner 10 can also be provided with one or more additional filters upstream or downstream of the collection assembly 18.

The upright body 12 also has an elongated handle 26 extending upwardly from the spine 16 that is provided with a hand grip 28 at one end that can be used for maneuvering the vacuum cleaner 10 over a surface to be cleaned. The handle 26 may be removable from the spine 16 for use as a wand for above-the-floor cleaning. A hose 30 is coupled between one end of the handle 26 and a diverter assembly (not shown) which places the collection assembly 18 in selective communication with the base 14 for on-the-floor cleaning or with the handle 26 and hose 30 for above-the-floor cleaning. A motor housing 32 is formed at a lower end of the spine 16 and contains a conventional suction motor (FIG. 3) positioned therein in fluid communication with the collection assembly 18.

Figure 2:
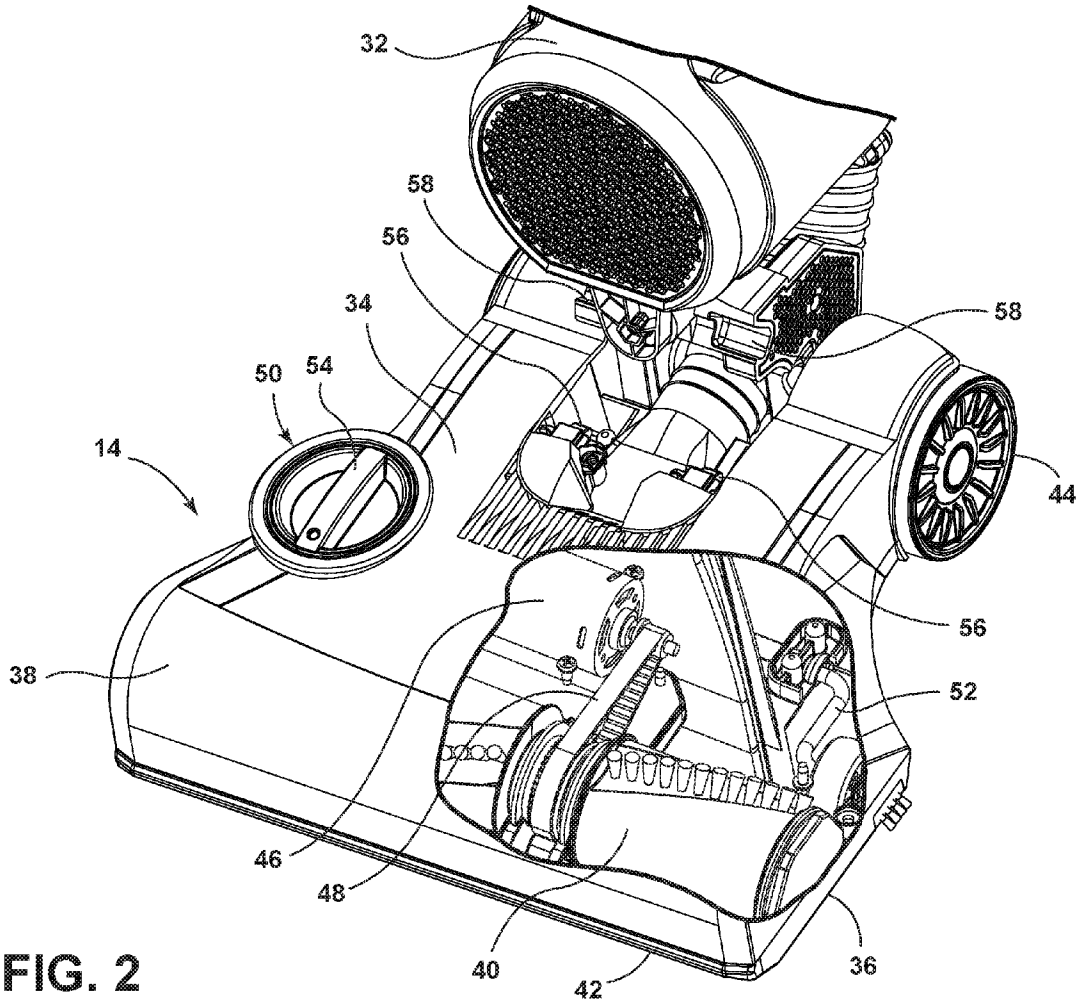
FIG. 2 is a perspective view of a base of the vacuum cleaner from FIG. 1, where the base of the vacuum cleaner is partially cut away to show some internal features of the base.

FIG. 2 is a perspective view of a base 14 of the vacuum cleaner from FIG. 1. In FIG. 2, a portion of the base 14 of the vacuum cleaner 10 is cut away to show some internal features of the base 14. The base 14 can include an upper housing 34 that couples with a lower housing 36 to create a partially enclosed space therebetween. A brushroll housing 38 can be provided at a forward portion of the lower housing 36 and defines a chamber for receiving a brushroll 40. A suction nozzle opening 42 is formed in the lower housing 36 and is in fluid communication with the brushroll housing 38 and the collection assembly 18. Wheels 44 can be provided on the base 14 for maneuvering the vacuum cleaner 10 over a surface to be cleaned.

The brushroll 40 is positioned within the brushroll housing 38 for rotational movement about a central longitudinal axis. A single brushroll 40 is illustrated; however, it is within the scope of the invention for dual rotating brushrolls or other agitator configurations to be used. Moreover, it is within the scope of the invention for the brushroll 40 to be mounted within the brushroll housing 38 in a fixed or floating vertical position relative to the brushroll housing 38 and lower housing 36. In another embodiment, one or more brushrolls or agitators can be provided which are driven for rotation about a vertical axis.

The brushroll 40 can be operably coupled to and driven by a dedicated brushroll motor 46 in the base 14. A drive belt 48 operably connects the brushroll motor 46 to the brushroll 40 for transmitting rotational motion to the brushroll 40. The base 14 can further include an optional suction nozzle height adjustment mechanism 50 for adjusting the height of the suction nozzle opening 42 with respect to the surface to be cleaned. The height adjustment mechanism 50 can include a wheeled carriage 52 which lifts and lowers the front end of the base 14 relative to the surface to be cleaned. A rotatable knob 54 for actuating the adjustment mechanism 50 can be provided on the exterior of the base 14. In other embodiments of the invention, the suction nozzle height adjustment mechanism can be eliminated.

Figure 6:
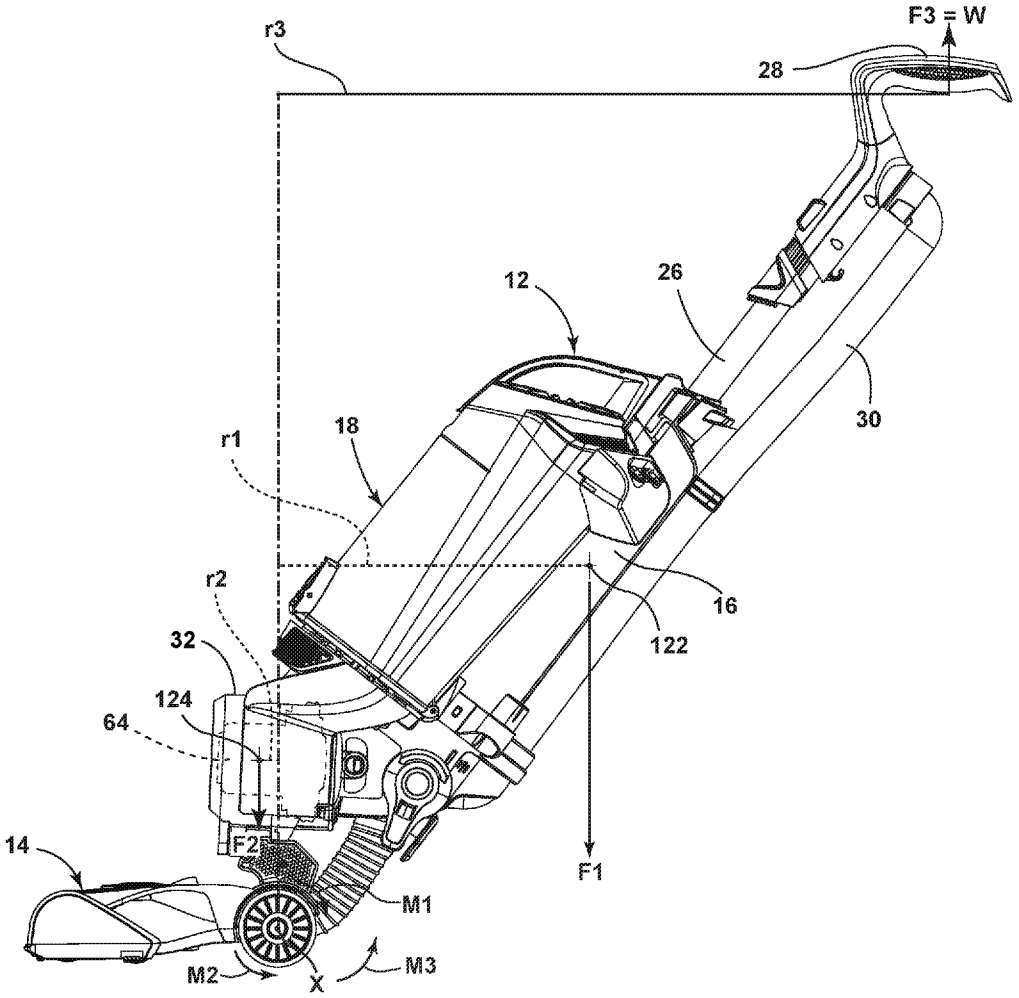
FIG. 6 is a side view of the vacuum cleaner from FIG. 1 in a reclined use position.

The upright body 12 is pivotally mounted to the base 14 for movement between an upright storage position, shown in FIG. 1, and a reclined use position, shown in FIG. 6. The vacuum cleaner 10 can be provided with a detent mechanism for selectively releasing the upright body 12 from the storage position to the use position. In the illustrated embodiment, the detent mechanism includes spring loaded detent pins 56 on the base 14 that are received in detent notches 58 in a lower portion of the upright body 12 to hold the upright body 12 in the upright storage position. The pins 56 can be released from the notches 58 by stepping on the base 14 while pulling the upright body 12 backward. In other embodiments, other known detent mechanisms may be used, such as a detent pedal pivotally mounted to the base 14.

Figure 3:
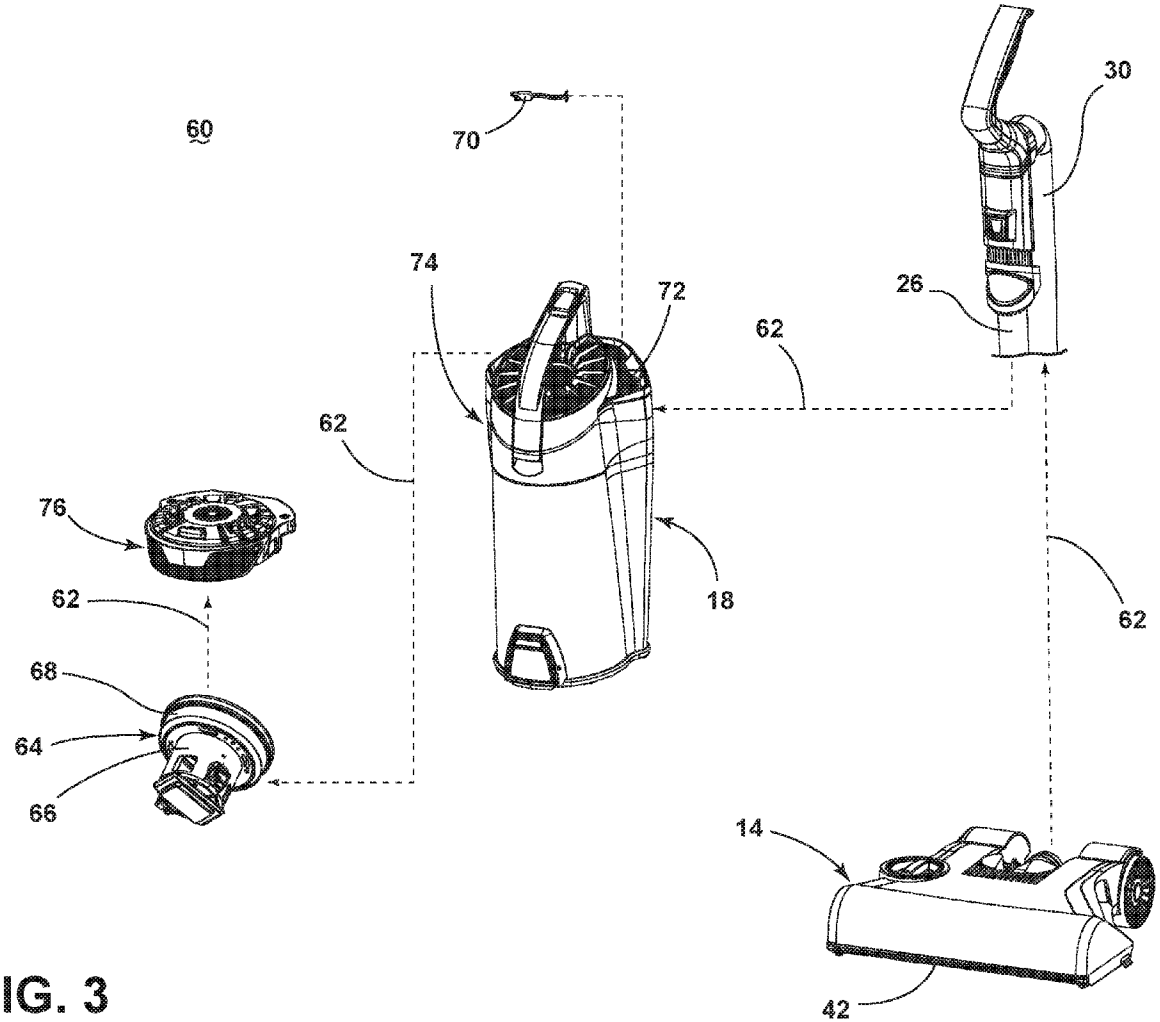
FIG. 3 is a schematic view of a vacuum collection system of the vacuum cleaner from FIG. 1.

FIG. 3 is a schematic view of the vacuum collection system 60 of the vacuum cleaner 10. The vacuum collection system 60 can include a working air path 62 through the vacuum cleaner 10, which may include one or more of the suction nozzle opening 42, a motor/fan assembly 64 in fluid communication with the suction nozzle opening 42 for generating a working air stream, and the collection assembly 18 for separating and collecting debris from the working airstream for later disposal. The working air path 62 can further include various air conduits for fluid communication between the various components of the vacuum collection system 60, including, but not limited to, the vacuum hose 30 and the handle 26.

The motor/fan assembly 64, which may include a motor 66 and a fan 68 coupled to the motor 66 for rotation about an axis, can be positioned within the motor housing 32 (FIG. 1) and fluidly downstream of the collection assembly 18 in the working air path 62. In other embodiments, the motor/fan assembly 64 may be located fluidly upstream of the collection assembly 18.

The motor/fan assembly 64 can be electrically coupled to a power source 70, such as a battery or by a power cord plugged into a household electrical outlet. A suction power switch 72 between the motor/fan assembly 64 and the power source 70 can be selectively closed by the user upon pressing the suction power switch 72, thereby activating the motor/fan assembly 64. The suction power switch 72 may also activate the brushroll motor 46.

The vacuum collection system 60 can also be provided with one or more additional filters upstream or downstream of the collection assembly 18 or the motor/fan assembly 64. In the embodiment illustrated herein, a pre-motor filter assembly 74 is provided with the collection assembly 18, and includes a pre-motor filter (not shown) which lies fluidly between the collection assembly and an inlet to the motor/fan assembly 64. A post-motor filter assembly 76 is also provided, and includes a post-motor filter (not shown) which is located fluidly downstream of an outlet from the motor/fan assembly 64.

The components of the vacuum cleaner 10 can be housed or carried on the upright body 12 or base 14 in various combinations. For example, in the embodiment shown herein, the collection assembly 18 and motor/fan assembly 64 can be provided on the upright body 12, while the suction nozzle opening 42, brushroll 40, and brushroll motor 46 can be provided on the base 14. Other configurations are possible. However, for the embodiments of the invention discussed herein, at least the motor/fan assembly 64 is provided on the upright body 12, while the suction nozzle opening 42 is provided on the base 14.

The vacuum cleaner 10 shown in FIGS. 1-3 can be used to effectively clean a surface by removing debris (which may include dirt, dust, soil, hair, and other debris) from the surface in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform vacuum cleaning, the motor/fan assembly 64 is coupled to the power source 70. The suction nozzle opening 42 is moved over the surface to be cleaned, generally in a series of forward and backward strokes. The motor/fan assembly 64 draws in debris-laden air through the suction nozzle opening 42 and into the collection assembly 18 where the debris is substantially separated from the working air. The air flow then passes the motor/fan assembly 64, and through any optional filters 74, 76, prior to being exhausted from the vacuum cleaner 10. During vacuum cleaning, the brushroll 40 can agitate debris on the surface so that the debris is more easily ingested into the suction nozzle opening 42. The collection assembly 18 can be periodically emptied of debris. Likewise, the optional filters 74, 76 can periodically be cleaned or replaced.

Figure 4:
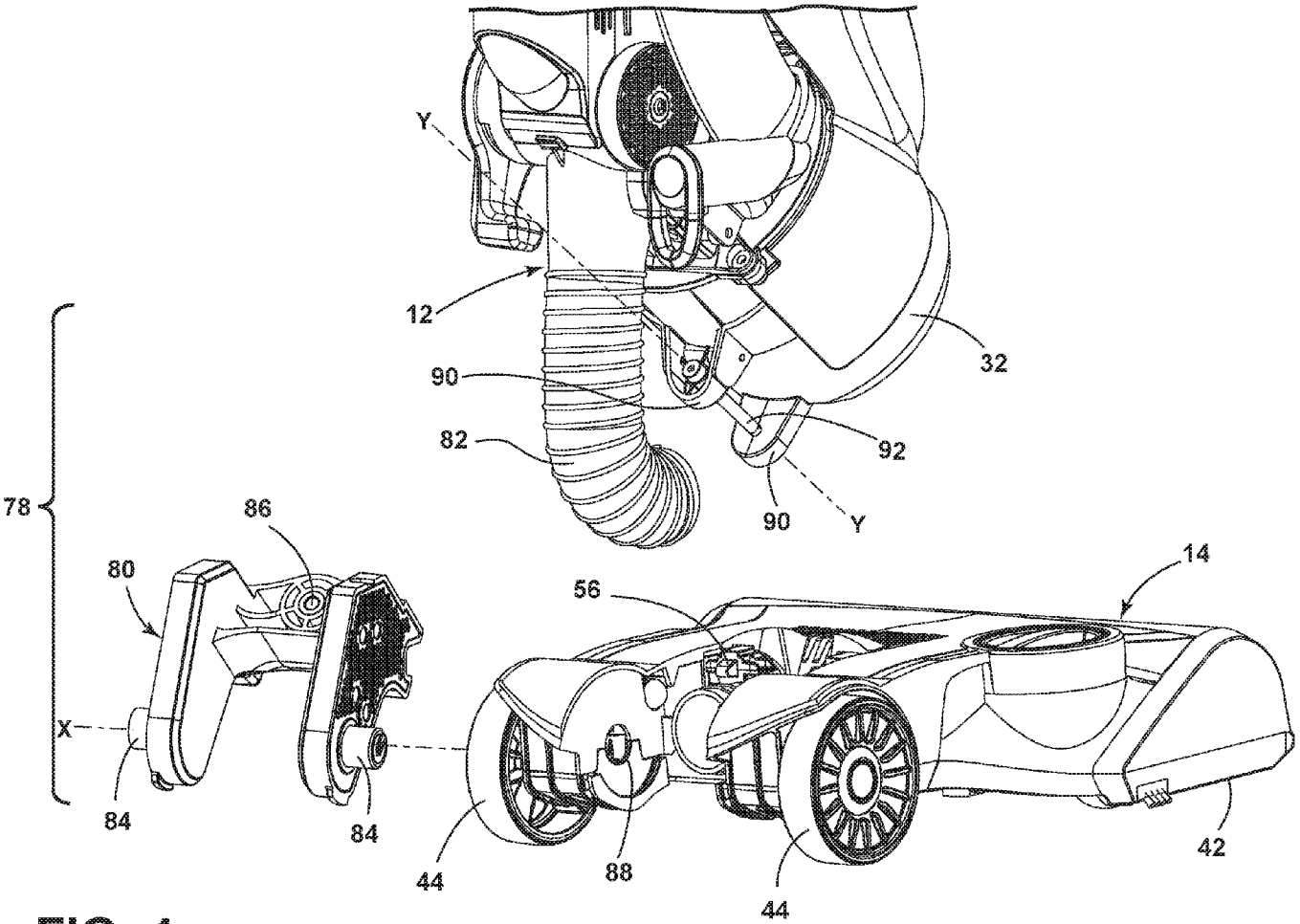
FIG. 4 is a partially exploded view of a pivot connection for the vacuum cleaner from FIG. 1.

FIG. 4 is a partially exploded view of a pivot connection 78 for the vacuum cleaner 10. As discussed above, the upright body 12 is pivotally mounted to the base 14 for movement between an upright storage position, shown in FIG. 1, and a reclined use position, shown in FIG. 6. The pivot connection 78 can be provided between the upright body 12 and the base 14 for coupling the upright body 12 to the base 14 for movement about at least one pivot axis. The pivot connection 78 of the illustrated embodiment permits movement about two pivot axes X, Y, and includes a yoke 80 straddling a working air duct 82 forming a portion of the working air path 62 (FIG. 3) and having oppositely-extending shaft pins 84 defining a first pivot axis of rotation X and a central coupler 86. The shaft pins 84 are received in bearings 88 formed on an inner surface of a rear cavity of the base 14 that provides a space for receiving a portion of the upright body 12. The central coupler 86 is rotatably coupled with a lower portion of the upright body 12. Specifically, as illustrated herein, the central coupler 86 can be coupled with an underside of the motor housing 32. The pivot connection 78 further includes bearing arms 90 that extend from the motor housing 32 and a pin or shaft 92 extending between the bearing arms 90 that is received by the central coupler 86 to define a second swivel axis of rotation Y. The pivot axis X is generally parallel to the surface over which the base 14 moves and generally transverse to the direction the base 14 travels during normal operation of the vacuum cleaner 10. The swivel axis Y is perpendicular to the pivot axis X, and is further generally oblique to the surface over which the base 14 moves and generally along to the direction the base 14 travels during normal operation of the vacuum cleaner 10. The upright body 12 can rotate forward and backward about the pivot axis X and side-to-side about the swivel axis Y, relative to the base 14.

Figure 5:
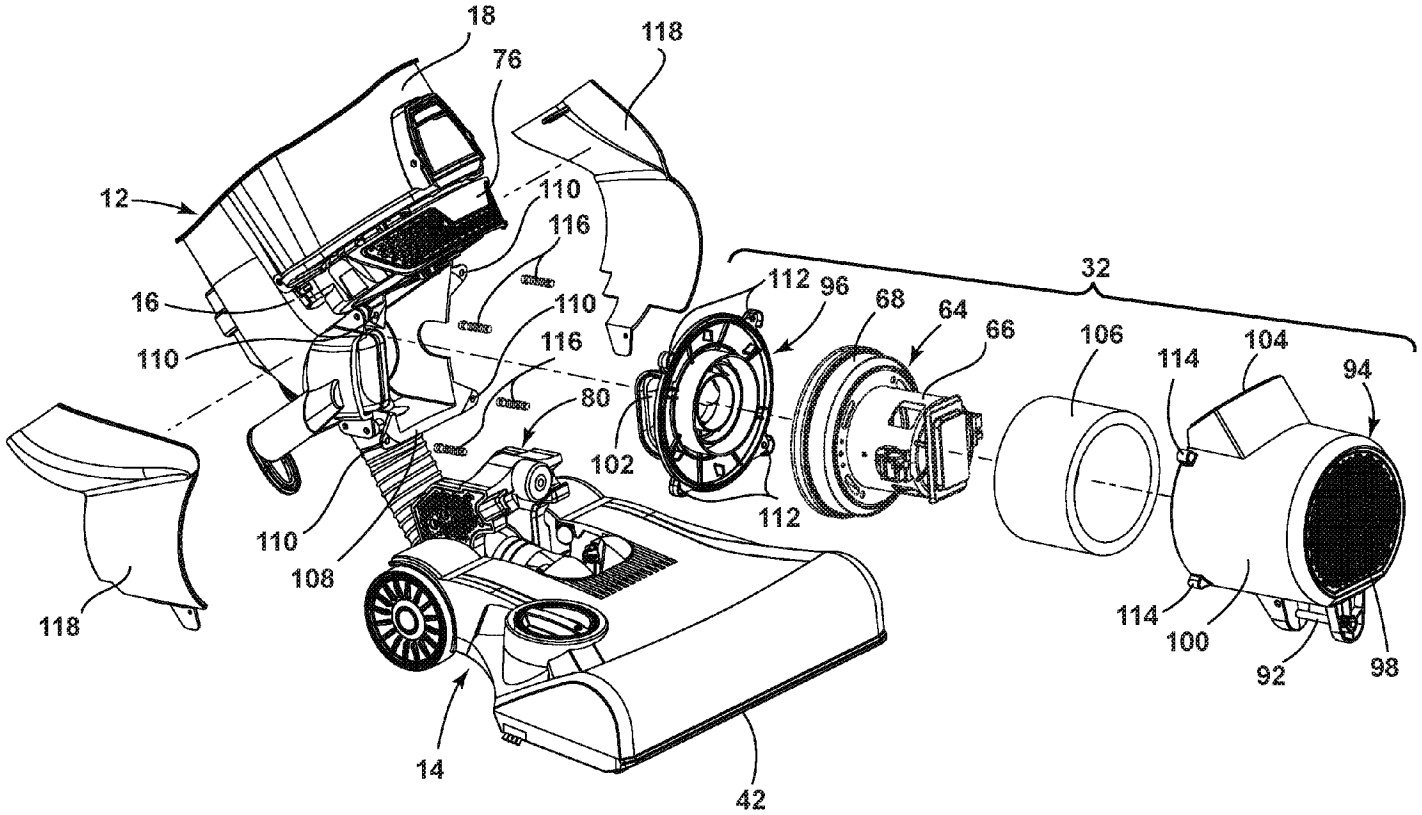
FIG. 5 is a partially exploded view of a motor assembly for the vacuum cleaner from FIG. 1.

FIG. 5 is a partially exploded view of the motor assembly for the vacuum cleaner 10. The motor assembly includes the motor housing 32 and the motor/fan assembly 64. The motor/fan assembly 64 is mounted within a motor housing 32, which includes a motor casing 94 and cover 96 for enclosing the motor/fan assembly 64 within the motor casing 94. The motor casing 94 can include an end wall 98 and a peripheral wall 100 extending from the end wall 98. The end wall 98 can be a front or forward end wall facing the direction the base 14 travels during normal operation of the vacuum cleaner 10. The cover 96 can be provided on a rear open end of the casing 94, and includes an air inlet 102 through which working air can flow from the collection assembly 18 into the fan 68. The motor casing 94 includes an air outlet 104 on the peripheral wall 100 that leads to the post-motor filter assembly 76. Insulation 106 can be placed between the motor 66 and the motor casing 94 to reduce the level of sound generated by the motor/fan assembly 64 during operation.

The motor housing 32 is coupled with the spine 16 of the upright body 12 in a cantilevered fashion, such that motor housing 32 projects forwardly from the spine 16. In being cantilevered to the upright body 12, the motor housing 32 is fixed with the upright body 12 at one end only, which may include being separately attached to the upright body 12 or integrally formed with the upright body 12.

In the illustrated embodiment, the motor housing 32 is a rigid structural member that is separately attached to the upright body 12. The spine 16 includes a lower end with a supporting mount 108 for the motor housing 32. The motor casing 94 is joined to the mount 108 on the spine 16, with the cover 96 in between, by mechanical coupling elements. In the illustrated embodiment, the mechanical coupling elements include through-holes 110, 112 on the mount 108 and cover 96, and blind holes 114 on the casing 94 which are aligned and secured together with fasteners 116, such as screws, but in other embodiments the motor housing 32 could be secured to the spine 16 using other conventional coupling elements.

Optionally, dress housings 118 can be disposed on portions of the motor housing 32 and lower end of the upright body 12 to conceal the mechanical coupling elements from direct view for a better aesthetic appearance. Left and right dress housings 118 can be provided, and can be wrapped around left and right portions of the motor housing 32. It is noted that, for the illustrated embodiment, the dress housings 118 do not provide structural support to the motor housing 32, and that the motor housing 32, and by extension the motor/fan assembly 64 inside the motor housing 32, is supported in a cantilevered fashion by the spine 16 of the upright body 12. For the illustrated embodiment, the cantilevered configuration includes the motor housing 32, which defines a rigid structural member supporting the motor/fan assembly 64, projecting from the supporting mount 108 to a free or unsupported end, defined by the front end wall 98.

It is also noted that in other embodiments of the vacuum cleaner 10, the motor housing 32 may be formed with or otherwise coupled to the upright body 12. For example, in another embodiment, the motor casing 94 may be integrally formed with the spine 16 or another portion of the upright body 12, and the front end wall 98 could be a separate cover that permits the motor/fan assembly 64 to be mounted within the motor casing 94 during assembly of the vacuum cleaner 10. Other configurations for the motor housing 32 are also possible.

The vacuum cleaner 10 of the invention is configured to have a reduced weight-in-hand, as perceived by the user, in the reclined or use position shown in FIG. 6. The reduced weight-in-hand is attributable to the configuration of the motor assembly, including the motor housing 32 and the motor/fan assembly 64, relative to the upright body 12. Reducing the weight-in-hand makes the vacuum cleaner 10 easier to maneuver, and the user is less prone to fatigue while vacuuming.

The weight-in-hand of the vacuum cleaner 10 is the resultant of a system of forces acting on the upright body 12 when it is reclined, including the sum of the moments of force about the pivot axis X. The sum of the moments of force (ΣM) acting on the reclined upright body 12 include the downward or clockwise, when viewed as in FIG. 6, moments of force applied by the reclined upright body 12 on a user's hand, minus the sum of any other moments of force acting on the upright body 12 in the opposite or counterclockwise direction, which would act to reduce or counterbalance the weight-in-hand.

A moment of force is the product of a force applied at a point and the distance or radius vector from the point to a rotational axis. When the force is supplied by the weight of an object, as in the case of the reclined vacuum cleaner 10, the point is defined by the center of gravity of that object. Here, the rotational axis is the pivot axis X between the upright body 12 and the base 14. Thus, the moment of force M1 for the upright body 12 is the product of the weight F1 of the upright body 12 and the distance r1 between the center of gravity 122 of the upright body 12 and the pivot axis X, per the following equation:

$$M1=F1\times r1$$

The distance r1 is the minimum distance between the vector defined by the weight F1 of the upright body 12 and the pivot axis X. The vector defined by the weight F1 extends toward the surface to be cleaned and is generally vertical. The distance r1 is perpendicular to the vector defined by the weight F1. In the illustrated embodiment, the distance r1 lies along a line parallel to the surface to be cleaned, which is typically horizontal.

The motor assembly, including the motor housing 32 and motor/fan assembly 64, provides a moment of force M2 acting in a downward, counterclockwise direction, and provides a counterbalance to the moment of force M1 acting on the reclined upright body 12. The moment of force M2 for the motor assembly is the product of the weight F2 of the motor assembly and the distance r2 between the center of gravity 124 of the motor assembly and the pivot axis X, in the reclined use position, per the following equation:

$$M2=F2\times r2$$

The distance r2 is the minimum distance between the vector defined by the weight F2 of the motor assembly and the pivot axis X. The vector defined by the weight F2 extends toward the surface to be cleaned and is generally vertical. The distance r2 is perpendicular to the vector defined by the weight F2. In the illustrated embodiment, the distance r2 lies along a line parallel to the surface to be cleaned, which is typically horizontal.

In the illustrated embodiment, the motor housing 32 protrudes forwardly from the lower end of the upright body 12 in cantilever fashion, such that significant portions of the motor/fan assembly 64 mounted inside the motor housing 32 are positioned forward of the pivot axis X, whereas the remaining portion of the upright body 12 is located rearward of the pivot axis X. Because the center of gravity of the motor assembly is located forward of the pivot axis X, it creates a counterclockwise moment of force M2 that offsets a portion of the moment of force M1 generated by the upright handle portion, which is clockwise about the pivot axis X.

The weight-in-hand W can be represented by a force F3 that is applied by a user to maintain the upright body 12 at a desired reclined position. For the illustrated vacuum cleaner 10, the user applies the force F3 on the hand grip 28 in an upward, counterclockwise direction, relative to the pivot axis X. A moment of force M3 acting on the upright body 12 is the product of the force F3 applied by a user and the distance r3 between the location at which force F3 is applied on the hand grip 28 and the pivot axis X, per the following equation:

$$M3=F3\times r3,\text{ or } M3=W\times r3$$

During operation, the upright body 12 is maintained at generally the same reclined position. While small variances may occur, a user will generally hold the upright body 12 at a constant angular position relative to the pivot axis X. Because the angular position of the upright body 12 is more or less at rest with respect to the pivot axis X, the summation of moments about the pivot axis X is equal to zero, per the following equation:

$$\Sigma M=M1-M2-M3=0$$

Due to the counteracting moments, the motor assembly moment of force M2 can reduce the weight-in-hand W required to offset the moment of force M1 of the upright body 12. Since the moments of force M1 and M2 act in opposite directions, the motor assembly moment of force M2 is subtracted from the moment of force M1 for the upright body 12, so the weight-in-hand W can be expressed per the following equations:

$$M3 = M1 - M2$$

$$W \times r3 = M1 - M2$$

$$W = \frac{(M1 - M2)}{r3}$$

In some embodiments of the invention, the magnitude of the motor assembly moment of force M2 can be increased to greatly reduce the weight-in-hand W.

It is noted that, at least for the illustrated embodiment, the weight F2 of the motor assembly is essentially the weight of the motor/fan assembly 64 alone. The weight of the motor housing 32 is relatively small compared to that of the motor/fan assembly 64, and so has little effect on the overall weight-in-hand. The motor housing 32 can be manufactured from relatively light-weight plastic. Conversely, because the motor/fan assembly 64 comprises heavy and dense metal components, relatively small changes in position of the motor/fan assembly 64 relative to the pivot axis X can impact the weight-in-hand W. Other features of the upright body 12 that are forward of the pivot axis X, such as portion of the dress housings 118, also contribute relatively minor amounts of weight to the moment of force M2. In one example, for purposes of calculating the approximate weight-in-hand W, the weight of the entire upright body 12, excluding only the weight of the motor/fan assembly 64, can be used as F1, and the weight of the motor/fan assembly 64 alone as F2. In other words, components such as the motor housing 32 and dress housings 118 can be factored for the moment of force M1, even though they actually may contribute to a portion of the moment of force M2, as their overall effect on the weight-in-hand is negligible. Likewise, the center of gravity 122 can be the center of gravity of the entire upright body 12, and the center of gravity 124 can be the center of gravity of the motor/fan assembly 64 alone.

The structure of the upright body 12 can be configured in different ways to vary its total weight and adjust the location of its center of gravity, which can increase or decrease the moment of force about the pivot axis X, thereby resulting in higher or lower weight-in-hand accordingly. For example, an upright body 12 with a relatively low center of gravity in close proximity to the base 14, will generate a smaller moment of force M1 about the pivot axis X and a lighter weight-in-hand when the handle is in a reclined in-use position compared to a handle with a relatively higher center of gravity, located further from the base 14, which will generate a larger moment of force about the pivot axis X and a heavier weight in hand.

Figure 7:
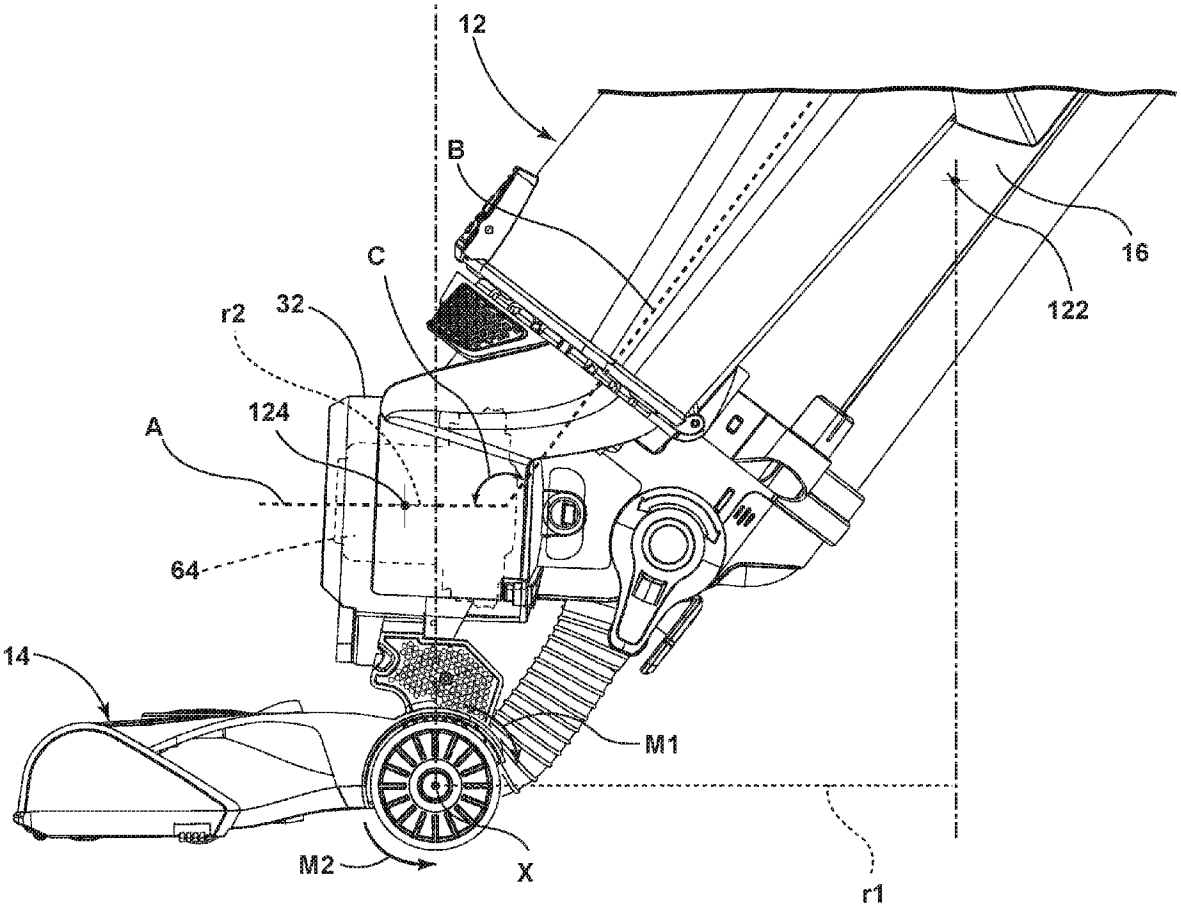
FIG. 7 is a close-up side view of the lower portion of the vacuum cleaner from FIG. 1 in a reclined use position.

FIG. 7 is a close-up side view of the lower portion of the vacuum cleaner from FIG. 1 in a reclined use position. As shown in the illustrated embodiment, the motor/fan assembly 64 can be mounted in an orientation such that a motor axis A (i.e. the rotational axis of the fan) is parallel to swivel axis Y. The included angle formed between the motor axis A and the longitudinal axis B of the upright body 12 (i.e. the longitudinal axis of the handle 26) forms an obtuse angle C. The obtuse angle C is greater than 90 degrees and less than 180 degrees. Previous vacuum cleaners have had other configurations, such as a motor axis parallel to and in front of the longitudinal axis of the upright body, or an orthogonal relationship where the motor axis is 90 degrees to the longitudinal axis and in front of pivot axis between the base and the upright body. These prior designs are not ideal because they do not maximize the distance r2, which essentially acts as a lever arm, in the reclined use position thereby increasing the magnitude of the motor assembly moment of force M2. The illustrated embodiment, with the obtuse angle C between the motor axis A and the longitudinal axis B maximizes the lever arm between the motor center of gravity 124 and pivot axis X when the upright body 12 is reclined, which thus maximizes the offsetting or counterbalancing moment of force M2 during operation. The prior configurations (parallel or orthogonal) result in a slightly shorter lever arms between the motor center of gravity and pivot axis when the handle is reclined, as these designs maximize the lever arm when the upright body is in the upright storage position. As a result, the prior designs are not beneficial for reducing the weight-in-hand.

In the upright storage position, the longitudinal axis B of the upright body 12 can be substantially vertical, including a deviation of up to 15-20 degrees in either direction from vertical. In the illustrated embodiment, the motor axis A is substantially parallel to the surface across which the vacuum cleaner is moved in the reclined use position, including a deviation of up to 15 degrees in either direction from horizontal. The obtuse angle C is greater than 90 degrees and less than 180 degrees, and may more preferably be between 110 and 160 degrees, depending on the recline of the upright body 12 relative to the motor housing 32 and motor axis A. The nominal height of the user of the vacuum cleaner may be taken into account when determining the desired value of obtuse angle C such that the motor axis A is substantially parallel to the surface during use even though a taller person may operate the vacuum cleaner with the upright body 12 reclined less during use than a shorter person. The illustrated embodiment incorporates an obtuse angle C of 125 degrees.

The weight offset by the cantilever motor configuration is maximized when the motor axis A is substantially parallel to the floor, which effectively defines "horizontal" for the vacuum cleaner. However, a user's height and arm length ultimately control handle grip position, and thus the position of motor axis A relative to the floor. Most users will use the vacuum cleaner in a position where the motor axis A is within 15 degrees from parallel to the floor, and the differences in the weight offset by cantilever motor configuration within this range is minimal.

The vacuum cleaner disclosed herein provides an improved mounting configuration for the motor and other components of the vacuum cleaner. One advantage that may be realized in the practice of some embodiments of the described vacuum cleaner is that the motor in fluid communication with the suction nozzle is mounted in the upright assembly in a cantilevered configuration that partially offsets the weight-in-hand of the upright assembly as perceived by a user of the vacuum cleaner. The reduced weight-in-hand makes it easier for the user to maneuver the vacuum cleaner without fatigue.

The disclosed embodiments are representative of preferred forms of the invention and are intended to be illustrative rather than definitive of the invention. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible within the forgoing disclosure and drawings without departing from the scope of the invention which is defined by the appended claims.

What is claimed is:

1. A vacuum cleaner, comprising:

a base adapted to be moved along a surface to be cleaned and having a suction nozzle positioned at a forward end of the base;

an upright body pivotally mounted to the base by a pivot connection for movement about a pivot axis between at least a storage position and a reclined use position; and a vacuum collection system comprising:

a motor/fan assembly provided in the upright body in fluid communication with the suction nozzle, wherein the motor/fan assembly comprises a motor axis that forms an angle between 110 and 160 degrees with a longitudinal axis of the upright body;

a collection assembly; and a working air path through the base and upright body, the working air path extending from the suction nozzle and through at least the motor/fan assembly and the collection assembly;

wherein the motor/fan assembly comprises a center of gravity that is located forwardly of the pivot axis in both the storage position and the reclined use position.

2. The vacuum cleaner of claim 1, wherein the motor/fan assembly is above the pivot axis.

3. The vacuum cleaner of claim 1, wherein the motor/fan assembly is located fluidly downstream of the collection assembly in the working air path.

4. The vacuum cleaner of claim 1, wherein the pivot connection further couples the upright body to the base for movement about a swivel axis, wherein the upright body can rotate forward and backward relative to the base about the pivot axis, and can rotate side-to-side relative to the base about the swivel axis.

5. The vacuum cleaner of claim 4, wherein the pivot connection comprises a yoke straddling a working air duct forming a portion of the working air path and coupled with the base to define the pivot axis.

6. The vacuum cleaner of claim 5, wherein the yoke further comprises a central coupler that is rotatably coupled with a lower portion of the upright body to define the swivel axis.

7. The vacuum cleaner of claim 6, wherein the upright body comprises a motor housing at a lower end thereof in which the motor/fan assembly is mounted, and wherein the central coupler is rotatably coupled with the motor housing.

8. The vacuum cleaner of claim 1, wherein the upright body comprises a motor housing at a lower end thereof, and wherein the motor/fan assembly is mounted within the motor housing.

9. The vacuum cleaner of claim 8, wherein the motor housing comprises at least an end wall and a peripheral wall extending from the end wall, and wherein the end wall is substantially vertical when the upright body is in the reclined use position.

10. The vacuum cleaner of claim 8, wherein the motor housing comprises air inlet through which working air from the collection assembly can flow, and an air outlet that leads to a post-motor filter assembly.

11. The vacuum cleaner of claim 1, wherein the upright body comprises a spine supporting the collection assembly and an elongated handle extending upwardly from the spine that is provided with a hand grip at one end, wherein the collection assembly is removably mounted on the spine.

12. The vacuum cleaner of claim 11, wherein the upright body further comprises a motor housing at a lower end of the spine, and wherein the motor/fan assembly is mounted within the motor housing in fluid communication with the collection assembly.

13. The vacuum cleaner of claim 12, wherein the motor housing is cantilevered to the spine such that motor housing projects forwardly from the spine.

14. A vacuum cleaner, comprising:

a base adapted to be moved along a surface to be cleaned and having a suction nozzle;

an upright body pivotally mounted to the base by a pivot connection for movement about a pivot axis between at least a storage position and a reclined use position and about a swivel axis, wherein the upright body can rotate forward and backward relative to the base about the pivot axis, and can rotate side-to-side relative to the base about the swivel axis; and a vacuum collection system comprising:

a motor/fan assembly provided in the upright body above the pivot axis and in fluid communication with the suction nozzle;

a collection assembly; and a working air path through the base and upright body, the working air path extending from the suction nozzle and through at least the motor/fan assembly and the collection assembly;

wherein the motor/fan assembly comprises a motor axis that is substantially parallel to the surface to be cleaned across which the base is moved in the reclined use position and that is parallel to the swivel axis;

wherein the motor axis forms an obtuse angle with a longitudinal axis of the upright body in both the storage position and the reclined use position.

15. The vacuum cleaner of claim 14, wherein the motor/fan assembly is located fluidly downstream of the collection assembly in the working air path.

16. The vacuum cleaner of claim 14, wherein the upright body comprises a spine supporting the collection assembly and a motor housing at a lower end of the spine, wherein the motor/fan assembly is mounted within the motor housing in fluid communication with the collection assembly, and wherein the motor housing is cantilevered to the spine such that motor housing projects forwardly from the spine.

17. A vacuum cleaner, comprising:

a base adapted to be moved along a surface to be cleaned and having a suction nozzle positioned at a forward end of the base;

an upright body pivotally mounted to the base by a pivot connection for movement about a pivot axis between at least a storage position and a reclined use position, and having a supporting mount at a lower end thereof;

a vacuum collection system comprising:

a motor/fan assembly in fluid communication with the suction nozzle;

a collection assembly; and a working air path through the base and upright body, the working air path extending from the suction nozzle and through at least the motor/fan assembly and the collection assembly; and a motor housing containing the motor/fan assembly, wherein the motor housing is cantilevered to the upright body and projects forwardly from the supporting mount;

wherein at least a portion of the motor/fan assembly is positioned forward of the pivot axis in the reclined use position.

18. The vacuum cleaner of claim 17, wherein the motor/fan assembly comprises a center of gravity that is located forwardly of the pivot axis in both the storage position and the reclined use position, and wherein the motor/fan assembly comprises a motor axis that forms an obtuse angle with a longitudinal axis of the upright body in both the storage position and the reclined use position.

* * * * *